US008434196B1

(12) United States Patent
Murphey et al.

(10) Patent No.: US 8,434,196 B1
(45) Date of Patent: May 7, 2013

(54) MULTI-AXIS COMPLIANT HINGE

(75) Inventors: Thomas W. Murphey, Albuquerque, NM (US); Joseph N. Footdale, Albuquerque, NM (US)

(73) Assignee: The United States of America As Represented by the Secretary of the Air Force, Washington, DC (US)

( * ) Notice: Subject to any disclaimer, the term of this patent is extended or adjusted under 35 U.S.C. 154(b) by 284 days.

(21) Appl. No.: 12/555,044

(22) Filed: Sep. 8, 2009

(51) Int. Cl.
*E05D 1/00* (2006.01)

(52) U.S. Cl.
USPC ..... 16/225

(58) Field of Classification Search ..... 16/225–227; 403/291, 220; 52/653.2, 64, 108; 138/119; 267/158, 160, 225–227; 248/274.1, 172.6
See application file for complete search history.

(56) References Cited

U.S. PATENT DOCUMENTS 3,474,488 A * 10/1969 Kruzich ..... 16/225
3,830,011 A * 8/1974 Ochrymowich ..... 446/126
6,104,358 A * 8/2000 Parker et al. ..... 343/915
6,175,989 B1 * 1/2001 Carpenter et al. ..... 16/225
6,343,442 B1 * 2/2002 Marks ..... 52/71
6,772,479 B2 * 8/2004 Hinkley et al. ..... 16/225
6,889,411 B2 * 5/2005 Hinkley et al. ..... 29/11
7,009,578 B2 3/2006 Nolan
7,211,722 B1 5/2007 Murphy
7,354,033 B1 * 4/2008 Murphey et al. ..... 267/160
7,694,486 B2 * 4/2010 Murphy et al. ..... 52/645
2002/0056248 A1 * 5/2002 Warren ..... 52/648.1

* cited by examiner

*Primary Examiner* — Victor Batson
*Assistant Examiner* — Matthew Sullivan
(74) *Attorney, Agent, or Firm* — James M. Skorich

(57) ABSTRACT

Multi-axis compliant hinges used in conjunction with strut elements to form a collapsible structure. The hinges behaves similar to a pin-clevis hinges but have increased compliance during the deployment sequence allowing connected struts to translate and rotate finite amounts relative to each other. Once deployed, the hinges lock out to form strong and stiff joints. The hinge uses two opposing resilient tape spring surfaces for each axis. The opposing tape spring surfaces of each axis are joined together by rigid inserts at their ends opposite the common connection point and to which structural members or struts are connected.

7 Claims, 6 Drawing Sheets

MULTI-AXIS COMPLIANT HINGE

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND OF THE INVENTION

The present invention relates generally to compliant hinges used in deployable or reconfigurable mechanisms, and in particular to hinges that connects three or more struts, allows struts to translate and rotate finite amounts relative to each other, has increased compliance during deployment, and is locked out in a strong and stiff manner in its deployed configuration. A four strut version of the compliant hinge disclosed herein is the type of hinge required in a pending patent application Ser. No. 12/555,034, "Deployable Structures with Quadrilateral Reticulations."

In deployable or reconfigurable mechanisms, structural members must move relative to each other to accommodate folding. In many situations, the kinematics of the mechanism are such that pin-clevis joints provide sufficient relative motion. A good example of this is the SquareRigger structure disclosed in U.S. Pat. No. 7,211,722. In this structure, articulation of the hinges is sufficient to deploy the structure without deformation of any members. In other words, the structure could be composed of rigid elements connected by pin-clevis joints and no internal stresses are generated during deployment. This class of mechanism is said to be compatible throughout its deployment, i.e., the member lengths and hinge locations are "compatible" with a stress free structural configuration. A problem associated with this class of structure is binding. Any strut or hinge length or alignment error generates internal loads in the mechanism, resulting in increased friction in the pin-clevis joints. Joint friction can cause these structures to bind and prevent deployment.

Structures that are not compatible throughout deployment generate internal loads and some compliance is required to prevent excessive loads from building up. These structures also need to be strong and stiff in the deployed configuration so that reducing the stiffness (adding compliance) to the struts results in a reduced stiffness deployed structure. What is needed is a hinge mechanism to render non-compatible structures deployable that behaves similar to a pin-clevis hinge, but has increased compliance during deployment and is locked out in a strong and stiff manner in the deployed configuration. A recognized hinge design demonstrating these characteristics is known as strain energy or tape measure hinge. The hinge bends about a single axis allowing the hinge to fold such that the once opposing ends are adjacent. Hinges of this type have been used on existing deployable structures. In applications requiring folding in multiple axes at a single location, such as in umbrella-type structures described in U.S. Pat. No. 7,009,578, multiple single-axis tape measure joints are connected to a central hub structure. The disadvantages of this type of joint include the increased mass and packaging dimensions due to the central hub.

SUMMARY OF THE INVENTION

A multi-axis compliant hinge is disclosed that is used in conjunction with strut elements to form a collapsible structure capable of supporting solar arrays, communication, radar, and electromagnetic energy concentration systems. The hinge uses a resilient material to provide flexibility to allow the desired level of articulation as well as the necessary stiffness when in the deployed or locked configuration. It allows struts to translate and rotate finite amounts relative to each other during deployment. The hinge is compatible with two- or three-dimensional collapsible structures and provides flexibility to prevent binding during the deployment process.

This invention provides a multi-axis compliant hinge that does not require a separate central hub structure. Therefore the design is lighter and more compact than the prior art. The hinge uses two opposing resilient tape spring monolithic surfaces, a top surface and a bottom surface. The opposing tape spring surfaces of each axis are joined together by rigid inserts at their ends opposite the common connection point. The rigid inserts serve as the mechanism for connecting the hinge to the respective structural members or struts. The hinge may also be fabricated in a single piece design, where the opposing surfaces are generated by removal of material from the mid-section. Both options are simple to manufacture and operate in a similar manner.

Embodiments of a two-axis symmetric, two-axis non-symmetric and three-axis hinge are described although the concept can be expanded to an increased number of axes limited by size and practical considerations only.

DESCRIPTION OF THE PREFERRED EMBODIMENT

The generation of deployable curved surface support structures requires a hinge that allows the struts being joined together to translate and rotate as well as form a strong and stiff connection in its deployed state. The compliant hinge of the present invention that encompasses these characteristics is realized with tape-spring-like shell elements. Tape-spring hinges are often used in deployable structures to serve as simple and reliable hinge mechanisms with strain energy capacity, which when released, can motivate the reconfiguration of the structural system from a packaged to a deployed state. A carpenter's measurement tape is an example of a tape spring. It has geometric stiffness when extended. Tape springs used in deployable structures are typically thin shells of a elastic material, such as spring steel, copper-beryllium alloys, or carbon fiber reinforced plastic (CFRP) that are curved about their primary structural axis. They can be buckled and folded about an arc. When released they spring back to their strain free shape and have a tendency to lock into this lower energy state.

Figure 1:
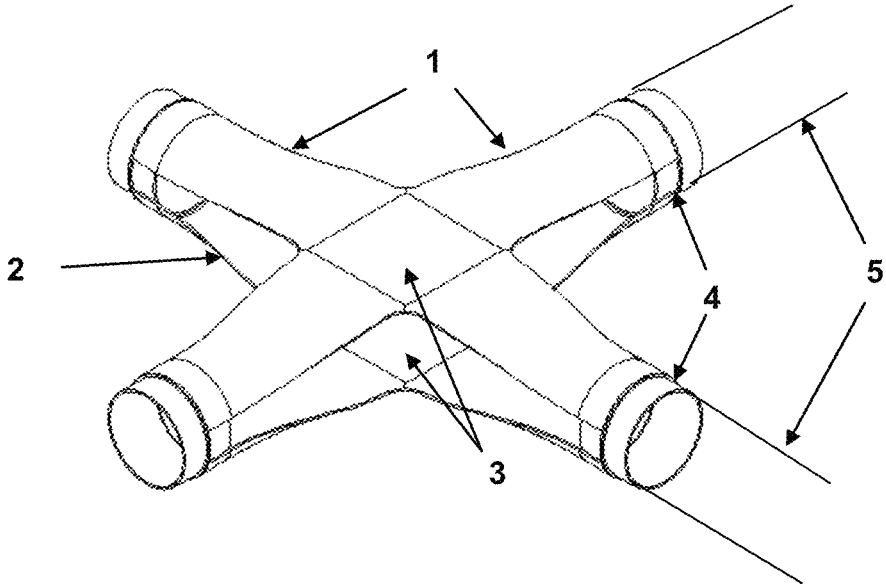
FIG. 1 shows a compliant hinge for connecting four members in a deployed configuration.
Figure 2:
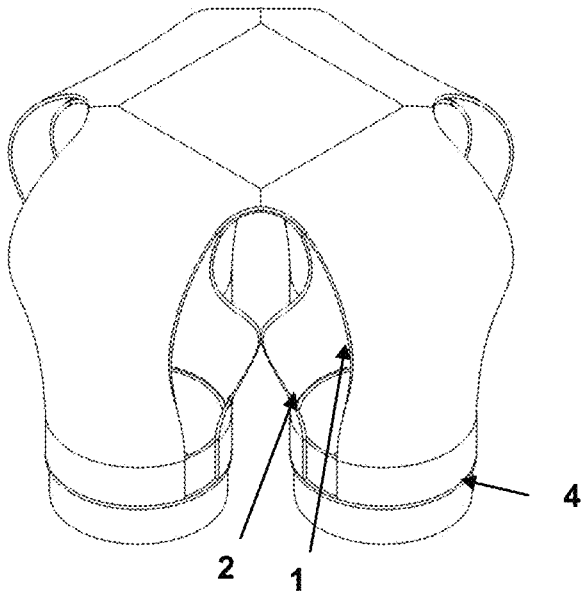
FIG. 2 shows the hinge or node of FIG. 1 in a packaged configuration.

In the two-axis, four-strut example seen in FIG. 1 and FIG. 2, the hinge uses two opposing resilient tape spring surfaces, a top surface 1 and a bottom surface 2 for each axis. For the two-piece design shown in FIG. 1 and FIG. 2, the opposing tape spring surfaces of each axis are joined together by rigid inserts 4 at their ends opposite the common connection point. The rigid inserts 4 serve as the mechanism for connecting the hinge to the respective structural members 5 (struts). The intersection of the two tape spring axes 3 shown in FIG. 1 is a deployed view of a hinge that would connect four members; FIG. 2 is a packaged view of the hinge. Hinge, node, or joint are here used interchangeably. The hinge is intended to connect three or more structural members 5 in a compliant hinge-table like manner, which allows relative translations and rotations of all members (struts) in the packaged state and during deployment. The members are locked out in a strong and stiff manner once deployed. The hinge's compliance allows it to be used in structures that are not fully compatible throughout deployment. A further feature of this compliant hinge is that it synchronizes the motion of all connected struts. In other words, rotation of one element tends to rotate all other elements attached to the node. This is a compliant synchronization in that the strut elements are only loosely coupled.

Figure 3:
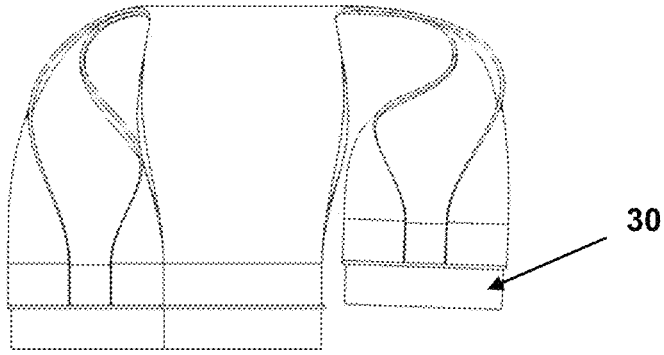
FIG. 3 shows the node of FIG. 2 with one structural member connection point translated relative to the others to show compliance in the packaged configuration.
Figure 4:
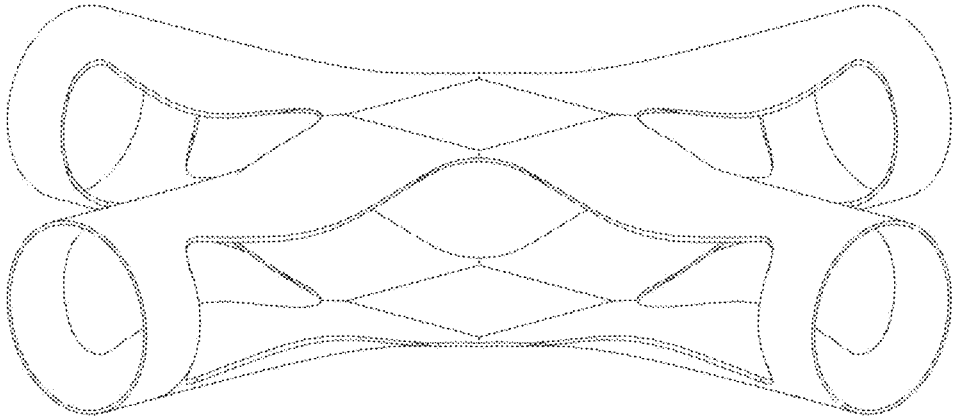
FIG. 4 shows a hinge fabricated in one piece with a flat center core section.
Figure 5:
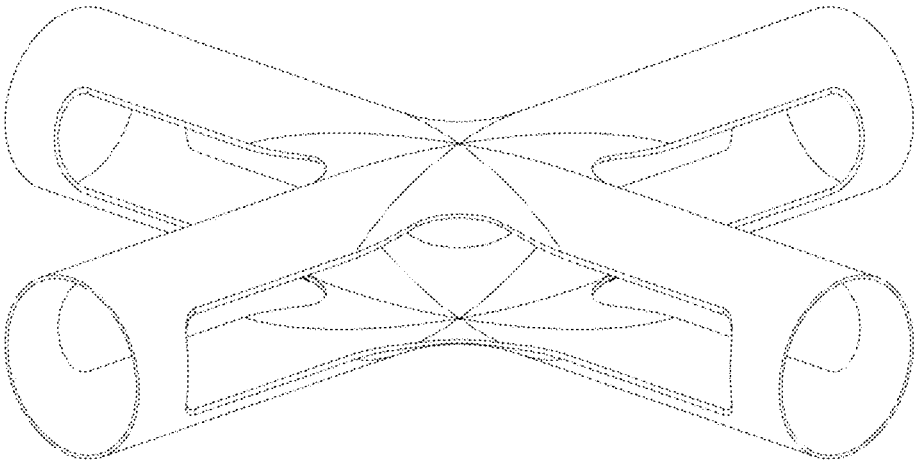
FIG. 5 shows a hinge fabricated in one piece with a curved center core section.
Figure 6:
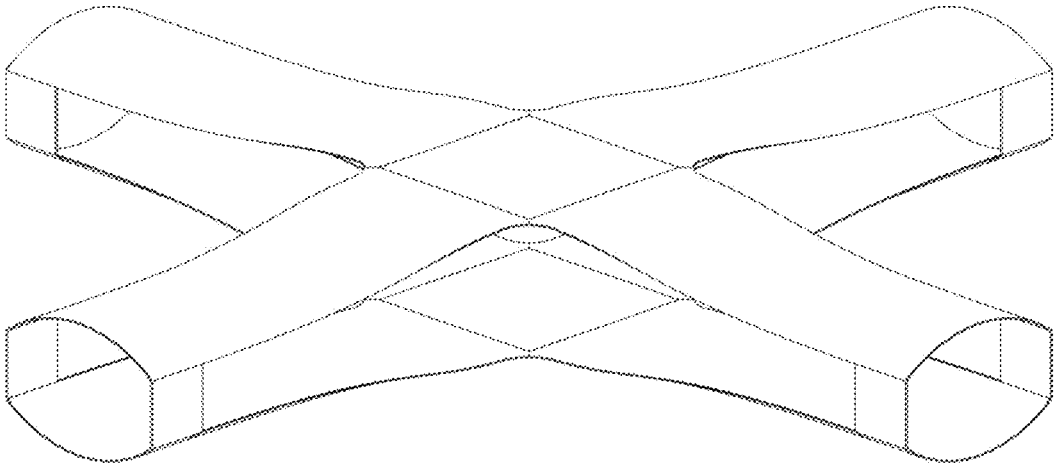
FIG. 6 shows a hinge where the extremities are non-cylindrical.

FIG. 3 is the FIG. 2 hinge with one structural member connection point 30 translated relative to the others to show compliance in the packaged configuration. FIG. 4 and FIG. 5 illustrate the one-piece option where the top and bottom surfaces are fused at the hinge extremities. The geometry of the hinge in FIG. 4 is formed by transitioning the cylindrical cross section at the hinge extremities to the center section, which is flat. The embodiment of FIG. 5 contains a center core section that maintains curvature. The amount of curvature in the center section is arbitrary and is designed to meet specific performance requirements. The cross section shape at the hinge ends is also arbitrary and can be designed to mate with struts of various cross sections, as illustrated in FIG. 6.

Figure 7A:
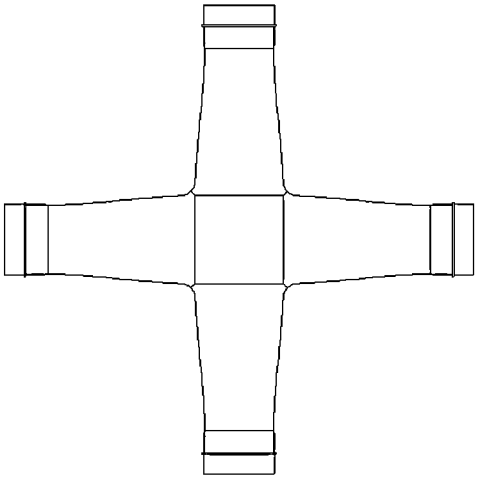
FIG. 7 is a top view of a four member node with a perpendicular alignment (7A) and with an arbitrary alignment (7B).
Figure 7B:
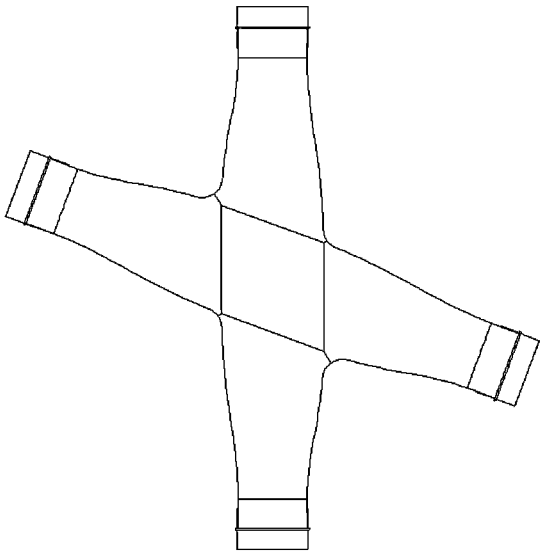
Figure 8A:
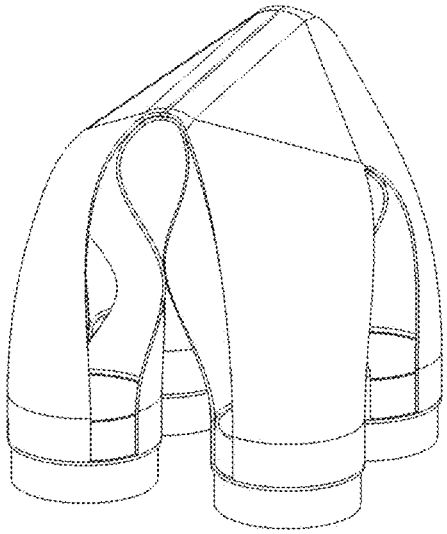
FIG. 8 shows an alternate folding configuration for a four member node in two views (8A and 8B).
Figure 8B:
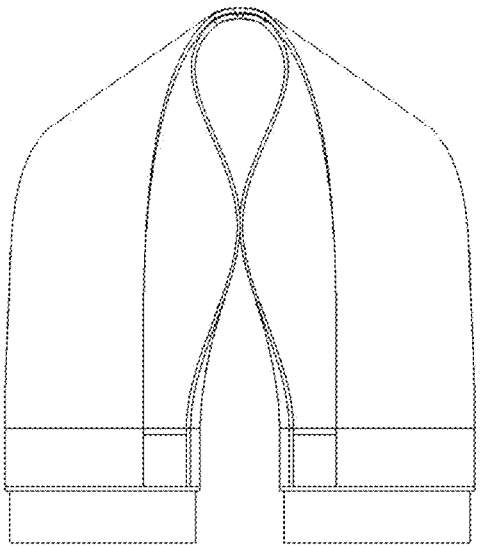
Figure 9A:
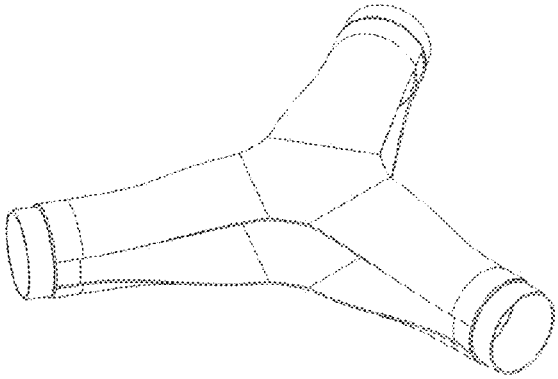
FIG. 9 shows a side (9A) and top view (9B) for a three member node.
Figure 9B:
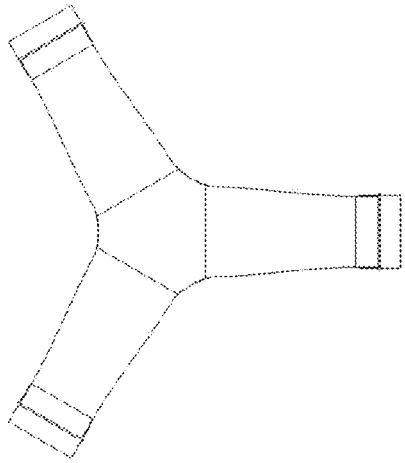
Figure 10:
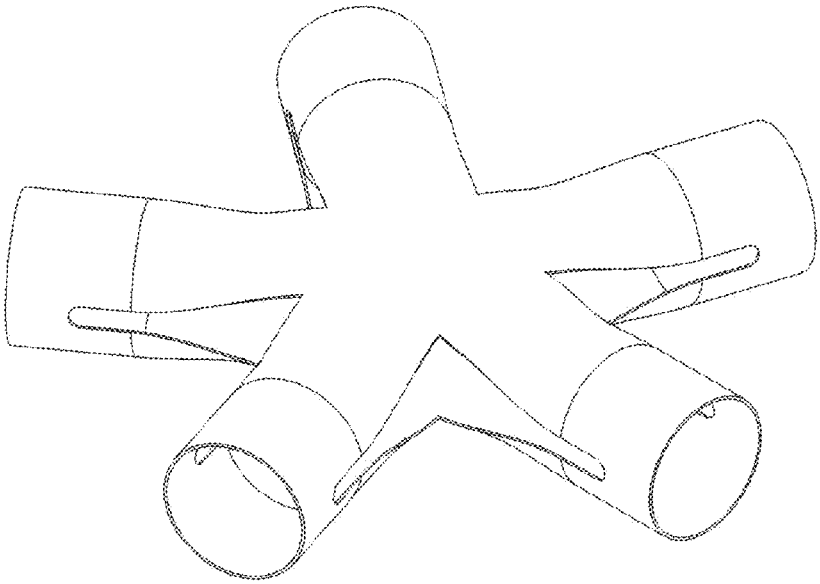
FIG. 10 is an example of a five member node.

FIG. 7A is a top view of a four member hinge with orthogonal angles and FIG. 7B is a top view of a four member hinge with arbitrary angles. The number of struts connected at a given hinge and the relative angles of the struts in the deployed configuration at the hinge point determines the angles of the hinge axes. FIG. 8 shows two views of an alternate folding configuration for a four member hinge. FIG. 9A is a side view of an exemplary deployed hinge for connecting three struts together converging from three different directions. FIG. 9B is a top view of the three member hinge. Finally, FIG. 10 is an example of a five member hinge in a deployed configuration.

The invention claimed is:

1. A multi-axis compliant hinge comprising:

a plurality of flexible members;

each of the members being formed from an upper shell and a lower shell, with the upper shell and lower shell opposing each other and being formed from an elastic, resilient material;

the members intersecting each other to form a core;

an upper core surface being formed by an intersection of the upper shells and a lower core surface being formed by an intersection of the lower shells;

the hinge being in a deployed configuration when the members lie linearly;

the upper and lower core surfaces having a singular space between them when the hinge is in the deployed configuration; and the space decreasing when a member becomes nonlinear by buckling outside of the core.

2. A hinge as defined in claim 1 wherein the upper and lower core surfaces are less flexible than sections of the upper and lower shells lying outside of the upper and lower core surfaces, respectively.

3. A hinge as defined in claim 1 wherein the hinge is formed from a unitary piece of the resilient material.

4. A hinge as defined in claim 3 wherein:

each of the members include two ends; and the upper and lower shells are fused together at each of the ends.

5. A hinge as defined in claim 1 wherein the upper and lower core surfaces are in contact only when the hinge is in the packaged configuration.

6. A hinge as defined in claim 5 wherein:

each of the members includes two ends; and each of the ends includes a rigid insert for connecting the upper and lower shells, and for connecting each of the ends to structural elements, respectively.

7. A hinge as defined in claim 1 wherein the upper and lower core surfaces are planar and lie in parallel when the hinge is in the deployed configuration, and become arcuate when the upper and lower shells lying outside of the upper and lower core surfaces, respectively, are buckled.

* * * * *